US005696873A

United States Patent [19]

Bartkowiak

[11] Patent Number: 5,696,873

[45] Date of Patent: Dec. 9, 1997

[54] VOCODER SYSTEM AND METHOD FOR PERFORMING PITCH ESTIMATION USING AN ADAPTIVE CORRELATION SAMPLE WINDOW

[75] Inventor: John G. Bartkowiak, Austin, Tex.

[73] Assignee: Advanced Micro Devices, Inc., Sunnyvale, Calif.

[21] Appl. No.: 620,758

[22] Filed: Mar. 18, 1996

[51] Int. Cl.[6] ..... G10L 9/08

[52] U.S. Cl. ..... 395/2.25; 395/2.16; 395/2.17; 395/2.23; 395/2.28; 395/2.67; 395/2.71; 395/2.72

[58] Field of Search ..... 395/2.16, 2.17, 395/2.23–2.25, 2.28, 2.67, 2.71, 2.72, 2.76, 2.77

[56] References Cited

U.S. PATENT DOCUMENTS

| | | | |
|---|---|---|---|
| 4,282,405 | 8/1981 | Taguchi | 395/2.26 |
| 4,441,200 | 4/1984 | Fette et al. | 395/2.16 |
| 4,544,919 | 10/1985 | Gerson . | |
| 4,802,221 | 1/1989 | Jibbe | 395/2.17 |
| 4,817,157 | 3/1989 | Gerson . | |
| 4,896,361 | 1/1990 | Gerson . | |
| 5,195,166 | 3/1993 | Hardwick et al. | 395/2.09 |
| 5,216,747 | 6/1993 | Hardwick et al. | 395/2.17 |
| 5,226,108 | 7/1993 | Hardwick et al. | 395/2.09 |
| 5,581,656 | 12/1996 | Hardwick et al. | 395/2.67 |

FOREIGN PATENT DOCUMENTS 0 532 225 A2 3/1993 European Pat. Off. .

OTHER PUBLICATIONS

Atkinson et al., "Pitch Detection of Speech Signals Using Segmented Autocorrelation," Electronics Letters, vol. 31, No. 7, Mar. 30, 1995, Stevenage, GB, XP000504300, pp. 533–535.

Hirose et al., "A Scheme for Pitch Extraction of Speech Using Autocorrelation Function With Frame Length Proportional to the Time Lag," International Conference on Acoustics, Speech and Signal Processing, 1992, vol. 1, 23–26, Mar. 1992, San Francisco, California, XP000341105, pp. 149–152.

International Search Report for PCT/US 97/01049 dated May 21, 1997.

ICASSP 82 Proceedings, May 3, 4, 5, 1982, Palais Des Congres, Paris, France, Sponsored by the Institute of Electrical and Electronics Engineers, Acoustics, Speech and Signal Processing Society, vol. 2 of 3, IEEE International Conference on Acoustics, Speech and Signal Processing, pp. 651–654.

*Primary Examiner*—Allen R. MacDonald
*Assistant Examiner*—Alphonso A. Collins
*Attorney, Agent, or Firm*—Conley, Rose & Tayon; Jeffrey C. Hood

[57] ABSTRACT

An improved vocoder system and method for estimating pitch in a speed waveform. The method comprises an improved correlation method for estimating the pitch parameter which more accurately disregards false correlation peaks resulting from the contribution of the First Formant to the pitch estimation method. The vocoder performs a correlation calculation on a frame of the speech waveform to estimate the pitch of the frame. According to the invention, during the correlation calculation the vocoder performs calculations to determine when a transition from unvoiced to voiced speech occurs. When such a transition is detected, the vocoder widens the correlation sample window. The present invention thus determines when a transition from unvoiced to voiced speech occurs and dynamically adjusts or widens the sample window to reduce the effect of the first Formant in the pitch estimation. Once this frame and the next have been classified as voiced, the correlation sample window can be reduced to its original value. Therefore, the present invention more accurately provides the correct pitch parameter in response to a sampled speech waveform.

29 Claims, 17 Drawing Sheets

Representation of Speech Signals

Range of bit rates for various types of speech representations.

Source-system model of speech production

General discrete-time model for speech production

Block diagram of simplified model for speech production

Fixed Window Method

Adaptive Window Method

Speech Waveform

VOCODER SYSTEM AND METHOD FOR PERFORMING PITCH ESTIMATION USING AN ADAPTIVE CORRELATION SAMPLE WINDOW

FIELD OF THE INVENTION

The present invention relates generally to a vocoder which receives speech waveforms and generates a parametric representation of the speech waveforms, and more particularly to an improved vocoder system and method including a correlation-based pitch estimator for estimating pitch using an adaptive correlation sample window.

DESCRIPTION OF THE RELATED ART

Digital storage and communication of voice or speech signals has become increasingly prevalent in modem society. Digital storage of speech signals comprises generating a digital representation of the speech signals and then storing those digital representations in memory. As shown in FIG. 1, a digital representation of speech signals can generally be either a waveform representation or a parametric representation. A waveform representation of speech signals comprises preserving the "waveshape" of the analog speech signal through a sampling and quantization process. A parametric representation of speech signals involves representing the speech signal as a plurality of parameters which affect the output of a model for speech production. A parametric representation of speech signals is accomplished by first generating a digital waveform representation using speech signal sampling and quantization and then further processing the digital waveform to obtain parameters of the model for speech production. The parameters of this model are generally classified as either excitation parameters, which are related to the source of the speech sounds, or vocal tract response parameters, which are related to the individual speech sounds.

FIG. 2 illustrates a comparison of the waveform and parametric representations of speech signals according to the data transfer rate required. As shown, parametric representations of speech signals require a lower data rate, or number of bits per second, than waveform representations. A waveform representation requires from 15,000 to 200,000 bits per second to represent and/or transfer typical speech, depending on the type of quantization and modulation used. A parametric representation requires a significantly lower number of bits per second, generally from 500 to 15,000 bits per second. In general, a parametric representation is a form of speech signal compression which uses a priori knowledge of the characteristics of the speech signal in the form of a speech production model. A parametric representation represents speech signals in the form of a plurality of parameters which affect the output of the speech production model, wherein the speech production model is a model based on human speech production anatomy.

Speech sounds can generally be classified into three distinct classes according to their mode of excitation. Voiced sounds are sounds produced by vibration or oscillation of the human vocal cords, thereby producing quasi-periodic pulses of air which excite the vocal tract. Unvoiced sounds are generated by forming a constriction at some point in the vocal tract, typically near the end of the vocal tract at the mouth, and forcing air through the constriction at a sufficient velocity to produce turbulence. This creates a broad spectrum noise source which excites the vocal tract. Plosive sounds result from creating pressure behind a closure in the vocal tract, typically at the mouth, and then abruptly releasing the air.

A speech production model can generally be partitioned into three phases comprising vibration or sound generation within the glottal system, propagation of the vibrations or sound through the vocal tract, and radiation of the sound at the mouth and to a lesser extent through the nose. FIG. 3 illustrates a simplified model of speech production which includes an excitation generator for sound excitation or generation and a time varying linear system which models propagation of sound through the vocal tract and radiation of the sound at the mouth. Therefore, this model separates the excitation features of sound production from the vocal tract and radiation features. The excitation generator creates a signal comprised of either a train of glottal pulses or randomly varying noise. The train of glottal pulses models voiced sounds, and the randomly varying noise models unvoiced sounds. The linear time-varying system models the various effects on the sound within the vocal tract. This speech production model receives a plurality of parameters which affect operation of the excitation generator and the time-varying linear system to compute an output speech waveform corresponding to the received parameters.

Referring now to FIG. 4, a more detailed speech production model is shown. As shown, this model includes an impulse train generator for generating an impulse train corresponding to voiced sounds and a random noise generator for generating random noise corresponding to unvoiced sounds. One parameter in the speech production model is the pitch period, which is supplied to the impulse train generator to generate the proper pitch or frequency of the signals in the impulse train. The impulse train is provided to a glottal pulse model block which models the glottal system. The output from the glottal pulse model block is multiplied by an amplitude parameter and provided through a voiced/unvoiced switch to a vocal tract model block. The random noise output from the random noise generator is multiplied by an amplitude parameter and is provided through the voiced/unvoiced switch to the vocal tract model block. The voiced/unvoiced switch is controlled by a parameter which directs the speech production model to switch between voiced and unvoiced excitation generators, i.e., the impulse train generator and the random noise generator, to model the changing mode of excitation for voiced and unvoiced sounds.

The vocal tract model block generally relates the volume velocity of the speech signals at the source to the volume velocity of the speech signals at the lips. The vocal tract model block receives various vocal tract parameters which represent how speech signals are affected within the vocal tract. These parameters include various resonant and unresonant frequencies, referred to as formants, of the speech which correspond to poles or zeroes of the transfer function V(z). The output of the vocal tract model block is provided to a radiation model which models the effect of pressure at the lips on the speech signals. Therefore, FIG. 4 illustrates a general discrete time model for speech production. The various parameters, including pitch, voice/unvoice, amplitude or gain, and the vocal tract parameters affect the operation of the speech production model to produce or recreate the appropriate speech waveforms.

Referring now to FIG. 5, in some cases it is desirable to combine the glottal pulse, radiation and vocal tract model blocks into a single transfer function. This single transfer function is represented in FIG. 5 by the time-varying digital filter block. As shown, an impulse train generator and random noise generator each provide outputs to a voiced/unvoiced switch. The output from the switch is provided to a gain multiplier which in turn provides an output to the time-varying digital filter. The time-varying digital filter performs the operations of the glottal pulse model block, vocal tract model block and radiation model block shown in FIG. 4.

One key aspect for generating a parametric representation of speech from a received waveform involves accurately estimating the pitch of the received waveform. The estimated pitch parameter is used later in re-generating the speech waveform from the stored parameters. For example, in generating speech waveforms from a parametric representation, a vocoder generates an impulse train comprising a series of periodic impulses separated in time by a period which corresponds to the pitch frequency of the speaker. Thus, when creating a parametric representation of speech, it is important to accurately estimate the pitch parameter. It is noted that, for an all digital system, the pitch parameter is restricted to be some multiple of the sampling interval of the system.

The estimation of pitch in speech using time domain correlation methods has been widely employed in speech compression technology. Time domain correlation is a measurement of similarity between two functions. In pitch estimation, time domain correlation measures the similarity of two sequences or frames of digital speech signals sampled at 8 KHz, as shown in FIG. 6. In a typical vocoder, 160 sample frames are used where the center of the frame is used as a reference point. As shown in FIG. 6, if a defined number of samples to the left of the point marked "center of frame" are similar to a similarly defined number of samples to the right of this point, then a relatively high correlation value is produced. Thus, detection of periodicity is possible using the so called correlation coefficient, which is defined as:

$$corcoef = \frac{\sum_{n=0}^{N-1} [x(n)-\bar{x}][x(n-d)-\overline{xd}]}{\sqrt{\sum_{n=0}^{N-1} [x(n)-\bar{x}]^2} * \sqrt{\sum_{n=0}^{N-1} [x(n-d)-\overline{xd}]^2}} \quad \text{Eqn (1)}$$

where $$\bar{x} = \frac{1}{N}\sum_{n=0}^{N-1} [x(n)] \text{ and } \overline{x(d)} = \frac{1}{N}\sum_{n=0}^{N-1} [x(n-d)] \quad \text{Eqn's (2) \& (3)}$$

The x(n−d) samples are to the left of the center point and the x(n) samples lie to the right of the center point. This function indicates the closeness to which the signal x(n) matches an earlier-in-time version of the signal x(n−d). This function displays the property that abs[corcoef]<=1. Also, if the function is equal to 1, x(n)=x(n−d) for all n.

When the delay d becomes equal to the pitch period of the speech under analysis, the correlation coefficient, corcoef, becomes maximum. In general, pitch periods for speech lie in the range 21–147 samples at 8 KHz. Thus for example, if the pitch is 57 samples, then the correlation coefficient will be high over a range of 57 samples. Thus, correlation calculations are performed for a number of samples N which varies between 21 and 147 in order to calculate the correlation coefficient for all possible pitch periods. The correlation sample window is generally set equal to the number of samples for which the correlation calculation is being performed. Thus 21 samples are used to calculate the correlation coefficient for a pitch period of 21, 22 samples are used to calculate the correlation coefficient for a pitch period of 22, and so on.

It is noted that a high value for the correlation coefficient will register at multiples of the pitch period, i.e., at 2 and 3 times the pitch period, producing multiple peaks in the correlation. In general, to remove extraneous peaks caused by secondary excitations, which are very common in voiced segments, the correlation function is clipped using a threshold function. Logic is then applied to the remaining peaks to determine the actual pitch of that segment of speech. These types of technique are commonly used as the basis for pitch estimation.

However, correlation-based techniques have limitations in accurately estimating this critical parameter under all conditions. In order to accurately estimate the pitch parameter, it is important to mitigate the effects of extraneous and misleading signal information which can confuse the estimation method. In particular, in speech which is not totally voiced, or contains secondary excitations in addition to the main pitch frequency, the correlation-based methods can produce misleading results. The First Formant in speech, which is the lowest resonance of the vocal tract, generally interferes with the estimation process, sometimes producing misleading results. These misleading results must be corrected if the speech is to be resynthesised with good quality. Pitch estimation errors in speech have a highly damaging effect on reproduced speech quality, and methods of correcting such errors play a key part in rendering good subjective quality. Therefore, techniques which reduce the contribution of the First Formant to the pitch estimation method are widely sought.

Therefore, an improved vocoder system and method for performing pitch estimation is desired which more accurately estimates the pitch of a received waveform. An improved vocoder system and method is also described which more accurately disregards the contribution of the First Formant to the pitch estimation method.

SUMMARY OF THE INVENTION

The present invention comprises an improved vocoder system and method for estimating pitch in a speech waveform. The vocoder receives digital samples of a speech waveform, wherein the speech waveform includes a plurality of frames each comprising a plurality of samples. The vocoder generates a plurality of parameters based on the speech waveform, including a pitch parameter which is the pitch or frequency of the speech samples. The present invention comprises an improved correlation method for estimating the pitch parameter which more accurately disregards false correlation peaks resulting from the contribution of the First Formant to the pitch estimation method.

The pitch estimation method of the present invention performs a correlation calculation on a frame of the speech waveform to estimate the pitch of the frame. According to the invention, during the correlation calculation the vocoder performs calculations to determine when a transition from unvoiced to voiced speech occurs. When such a transition is detected, the vocoder widens the sample window. The present invention thus determines when a transition from unvoiced to voiced speech occurs and dynamically adjusts or widens the sample window to reduce the effect of the first Formant in the pitch estimation.

In the preferred embodiment, during the correlation calculation the vocoder computes a long term frame energy parameter. This parameter is compared to the current frame energy to determine if a transition from unvoiced to voiced speech is occurring. When a voiced segment of speech is entered, the current energy increases by an amount which makes it much larger than the Long Term Energy Average by a fixed threshold. Thus, the long term frame energy parameter is compared to the current frame energy to determine if such a transition is occurring. If the current frame is determined to be a transition frame, the vocoder widens the correlation sample window. This reduces the effect of the first Formant in the pitch estimation. Once this frame and one or more subsequent frames have been classified as voiced, the correlation sample window can be reduced to its original values.

Therefore, the present invention more accurately provides the correct pitch parameter in response to a sampled speech waveform. More specifically, the present invention dynamically adjusts the pitch estimation window during unvoiced to voiced speech transitions. This improves the pitch estimation process and more accurately mitigates the effects of the First Formant on the pitch estimation.

BRIEF DESCRIPTION OF THE DRAWINGS

A better understanding of the present invention can be obtained when the following detailed description of the preferred embodiment is considered in conjunction with the following drawings, in which.

DETAILED DESCRIPTION OF THE PREFERRED EMBODIMENT

Incorporation by Reference

The following references are hereby incorporated by reference.

For general information on speech coding, please see Rabiner and Schafer, *Digital Processing of Speech Signals*, Prentice Hall, 1978 which is hereby incorporated by reference in its entirety. Please also see Gersho and Gray, *Vector Quantization and Signal Compression*, Kluwer Academic Publishers, which is hereby incorporated by reference in its entirety.

Voice Storage and Retrieval System

Figure 1:
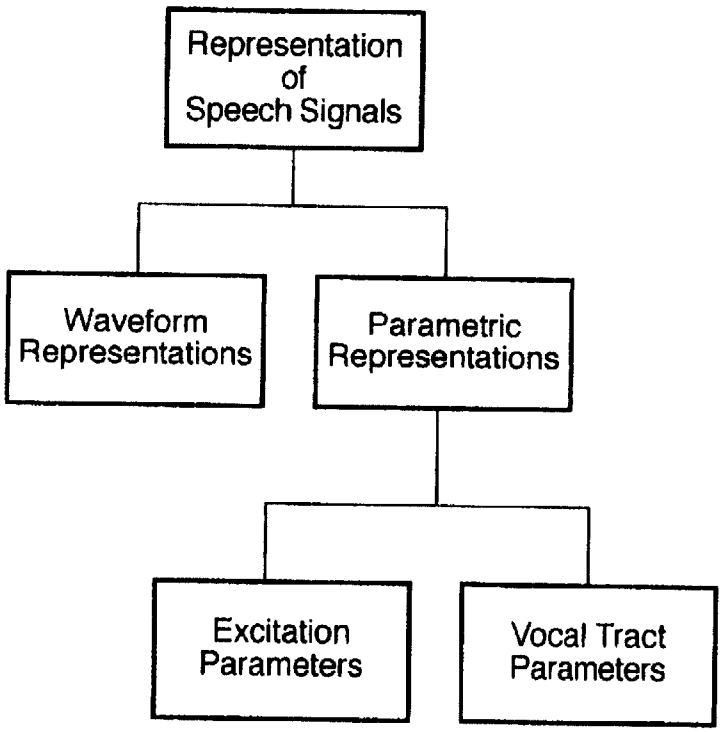
FIG. 1 (prior art)
FIG. 1 illustrates waveform representation and parametric representation methods used for representing speech signals.
Figure 2:
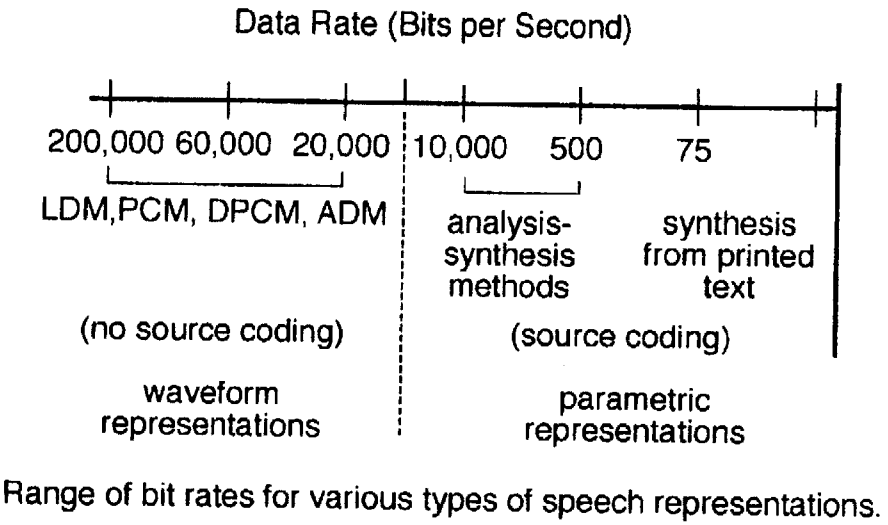
FIG. 2 (prior art)
FIG. 2 illustrates a range of bit rates for the speech representations illustrated in FIG. 1.
Figure 3:
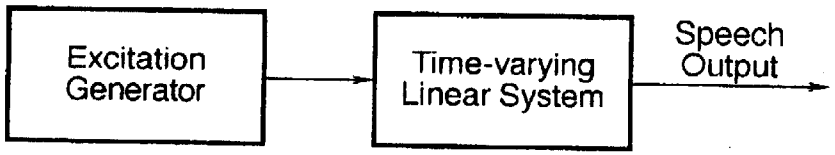
FIG. 3 (prior art)
FIG. 3 illustrates a basic model for speech production.
Figure 4:
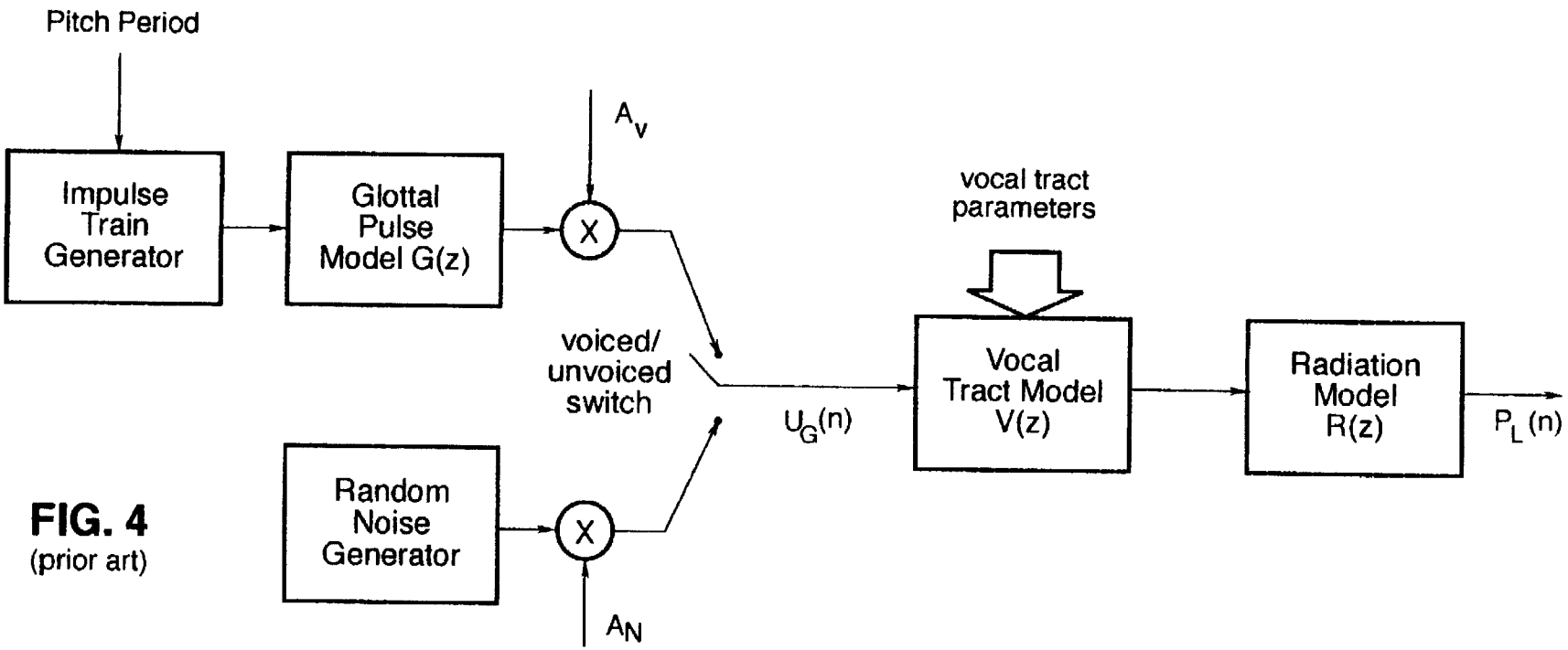
FIG. 4 (prior art)
FIG. 4 illustrates a generalized model for speech production.
Figure 5:
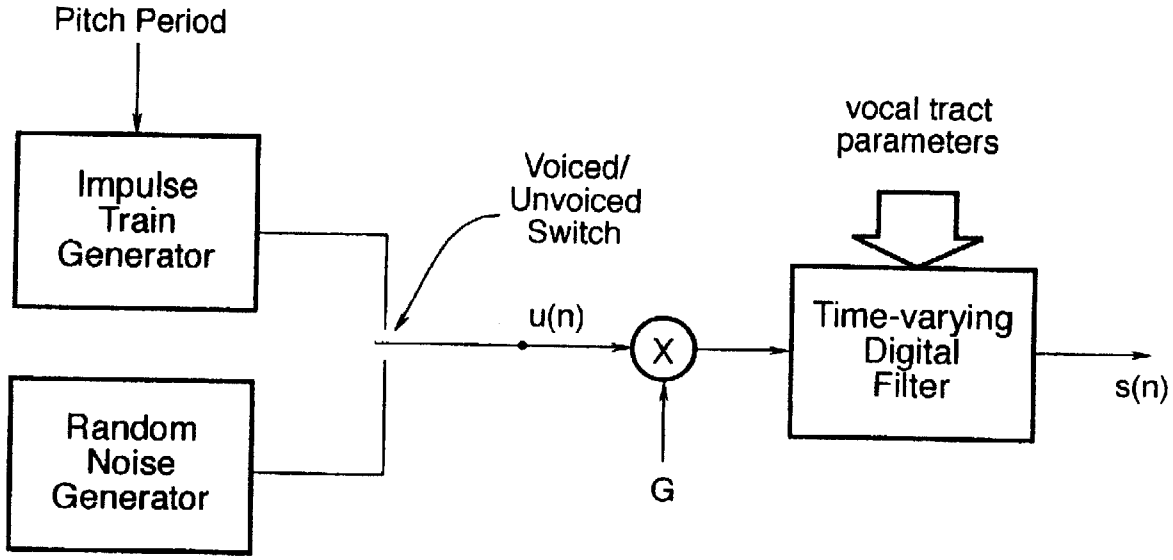
FIG. 5 (prior art)
FIG. 5 illustrates a model for speech production which includes a single time-varying digital filter.
Figure 6:
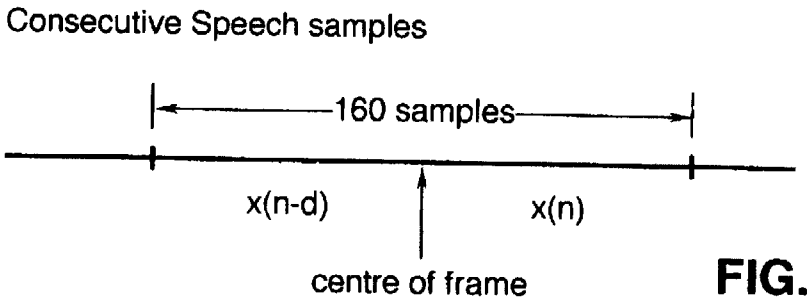
FIG. 6 illustrates a time domain correlation method for measuring the similarity of two sequences of digital speech samples.
Figure 7:
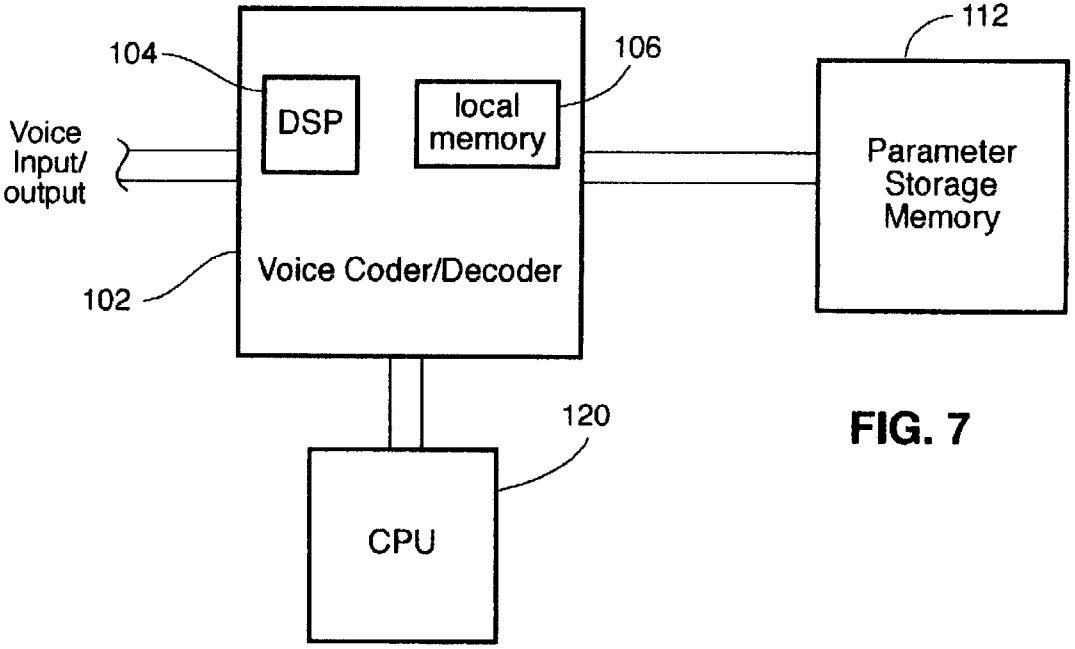
FIG. 7 is a block diagram of a speech storage system according to one embodiment of the present invention.

Referring now to FIG. 7, a block diagram illustrating a voice storage and retrieval system or vocoder according to one embodiment of the invention is shown. The voice storage and retrieval system shown in FIG. 7 can be used in various applications, including digital answering machines, digital voice mail systems, digital voice recorders, call servers, and other applications which require storage and retrieval of digital voice data. In the preferred embodiment, the voice storage and retrieval system is used in a digital answering machine.

As shown, the voice storage and retrieval system preferably includes a dedicated voice coder/decoder (codec) 102. The voice coder/decoder 102 preferably includes a digital signal processor (DSP) 104 and local DSP memory 106. The local memory 106 serves as an analysis memory used by the DSP 104 in performing voice coding and decoding functions, i.e., voice compression and decompression, as well as optional parameter data smoothing. The local memory 106 preferably operates at a speed equivalent to the DSP 104 and thus has a relatively fast access time.

The voice coder/decoder 102 is coupled to a parameter storage memory 112. The storage memory 112 is used for storing coded voice parameters corresponding to the received voice input signal. In one embodiment, the storage memory 112 is preferably low cost (slow) dynamic random access memory (DRAM). However, it is noted that the storage memory 112 may comprise other storage media, such as a magnetic disk, flash memory, or other suitable storage media. A CPU 120 is preferably coupled to the voice coder/decoder 102 and controls operations of the voice coder/decoder 102, including operations of the DSP 104 and the DSP local memory 106 within the voice coder/decoder 102. The CPU 120 also performs memory management functions for the voice coder/decoder 102 and the storage memory 112.

Alternate Embodiment

Figure 8:
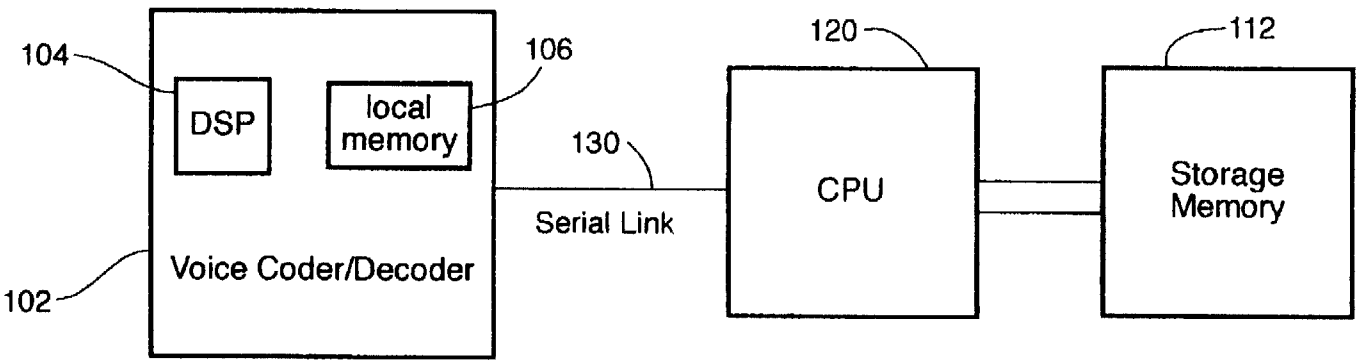
FIG. 8 is a block diagram of a speech storage system according to a second embodiment of the present invention.

Referring now to FIG. 8, an alternate embodiment of the voice storage and retrieval system is shown. Elements in FIG. 8 which correspond to elements in FIG. 7 have the same reference numerals for convenience. As shown, the voice coder/decoder 102 couples to the CPU 120 through a serial link 130. The CPU 120 in turn couples to the parameter storage memory 112 as shown. The serial link 130 may comprise a dumb serial bus which is only capable of providing data from the storage memory 112 in the order that the data is stored within the storage memory 112. Alternatively, the serial link 130 may be a demand serial link, where the DSP 104 controls the demand for parameters in the storage memory 112 and randomly accesses desired parameters in the storage memory 112 regardless of how the parameters are stored. The embodiment of FIG. 8 can also more closely resemble the embodiment of FIG. 7, whereby the voice coder/decoder 102 couples directly to the storage memory 112 via the serial link 130. In addition, a higher bandwidth bus, such as an 8-bit or 16-bit bus, may be coupled between the voice coder/decoder 102 and the CPU 120.

It is noted that the present invention may be incorporated into various types of voice processing systems having various types of configurations or architectures, and that the systems described above are representative only.

Encoding Voice Data

Figure 9:
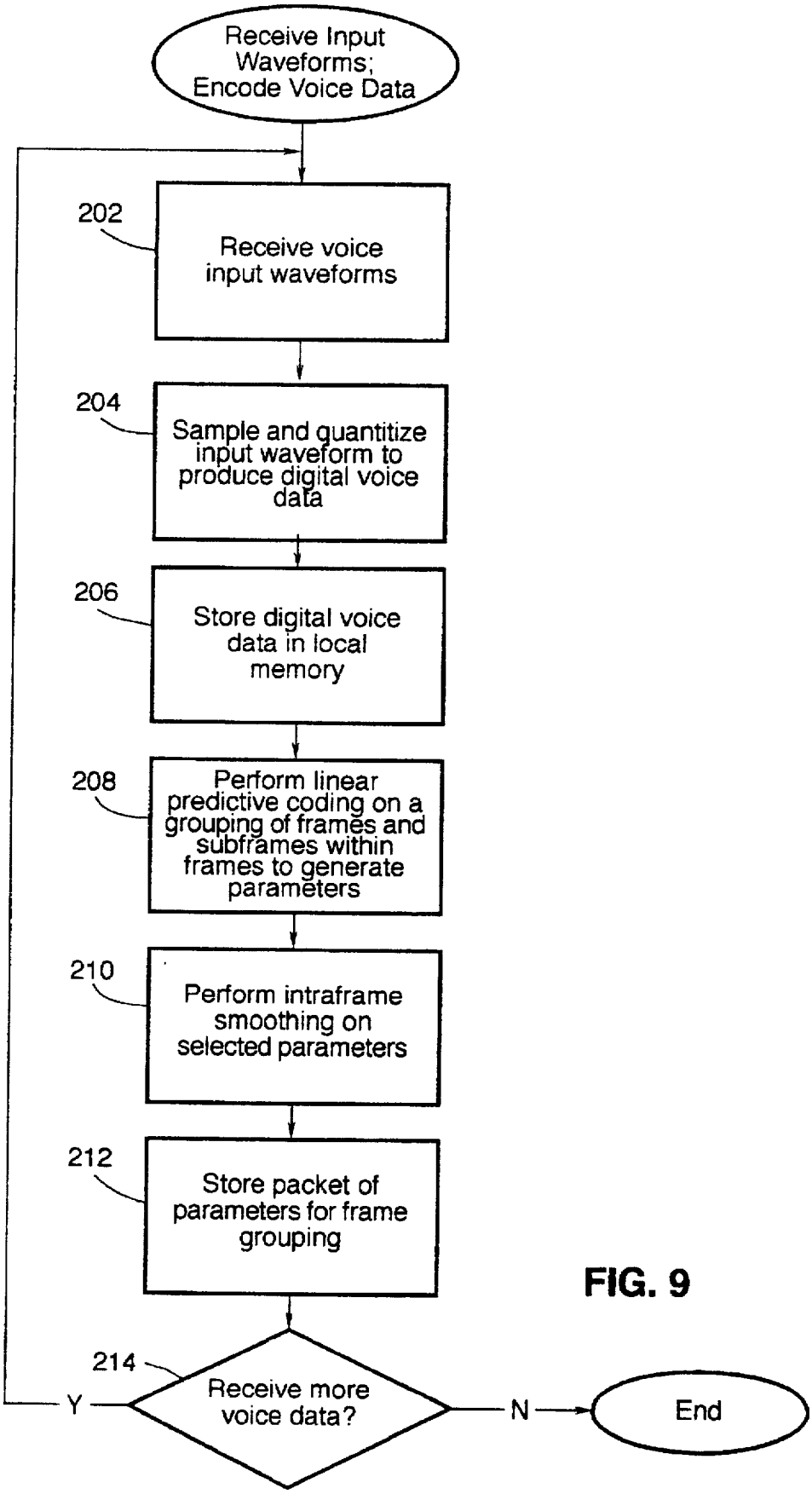
FIG. 9 is a flowchart diagram illustrating operation of speech signal encoding.

Referring now to FIG. 9, a flowchart diagram illustrating operation of the system of FIG. 7 encoding voice or speech signals into parametric data is shown. This figure illustrates one embodiment of how speech parameters are generated, and it is noted that various other methods may be used to generate the speech parameters using the present invention, as desired.

In step 202 the voice coder/decoder 102 receives voice input waveforms, which are analog waveforms corresponding to speech. In step 204 the DSP 104 samples and quantizes the input waveforms to produce digital voice data. The DSP 104 samples the input waveform according to a desired sampling rate. After sampling, the speech signal waveform is then quantized into digital values using a desired quantization method. In step 206 the DSP 104 stores the digital voice data or digital waveform values in the local memory 106 for analysis by the DSP 104.

While additional voice input data is being received, sampled, quantized, and stored in the local memory 106 in steps 202–206, the following steps are performed. In step 208 the DSP 104 performs encoding on a grouping of frames of the digital voice data to derive a set of parameters which describe the voice content of the respective frames being examined. Various types of coding methods, including linear predictive coding, may be used. It is noted that any of various types of coding methods may be used, as desired. For more information on digital processing and coding of speech signals, please see Rabiner and Schafer, *Digital Processing of Speech Signals*, Prentice Hall, 1978, which is hereby incorporated by reference in its entirety.

In step 208 the DSP 104 develops a set of parameters of different types for each frame of speech. The DSP 104 generates one or more parameters for each frame which represent the characteristics of the speech signal, including a pitch parameter, a voice/unvoice parameter, a gain parameter, a magnitude parameter, and a multi-based excitation parameter, among others. The DSP 104 may also generate other parameters for each frame or which span a grouping of multiple frames. The present invention includes a novel system and method for more accurately estimating the pitch parameter.

Once these parameters have been generated in step 208, in step 210 the DSP 104 optionally performs intraframe smoothing on selected parameters. In an embodiment where intraframe smoothing is performed, a plurality of parameters of the same type are generated for each frame in step 208. Intraframe smoothing is applied in step 210 to reduce these plurality of parameters of the same type to a single parameter of that type. However, as noted above, the intraframe smoothing performed in step 210 is an optional step which may or may not be performed, as desired.

Once the coding has been performed on the respective grouping of frames to produce parameters in step 208, and any desired intraframe smoothing has been performed on selected parameters in step 210, the DSP 104 stores this packet of parameters in the storage memory 112 in step 212. If more speech waveform data is being received by the voice coder/decoder 102 in step 214, then operation returns to step 202, and steps 202–214 are repeated.

Errors Which Occur Using Correlation

Figure 10:
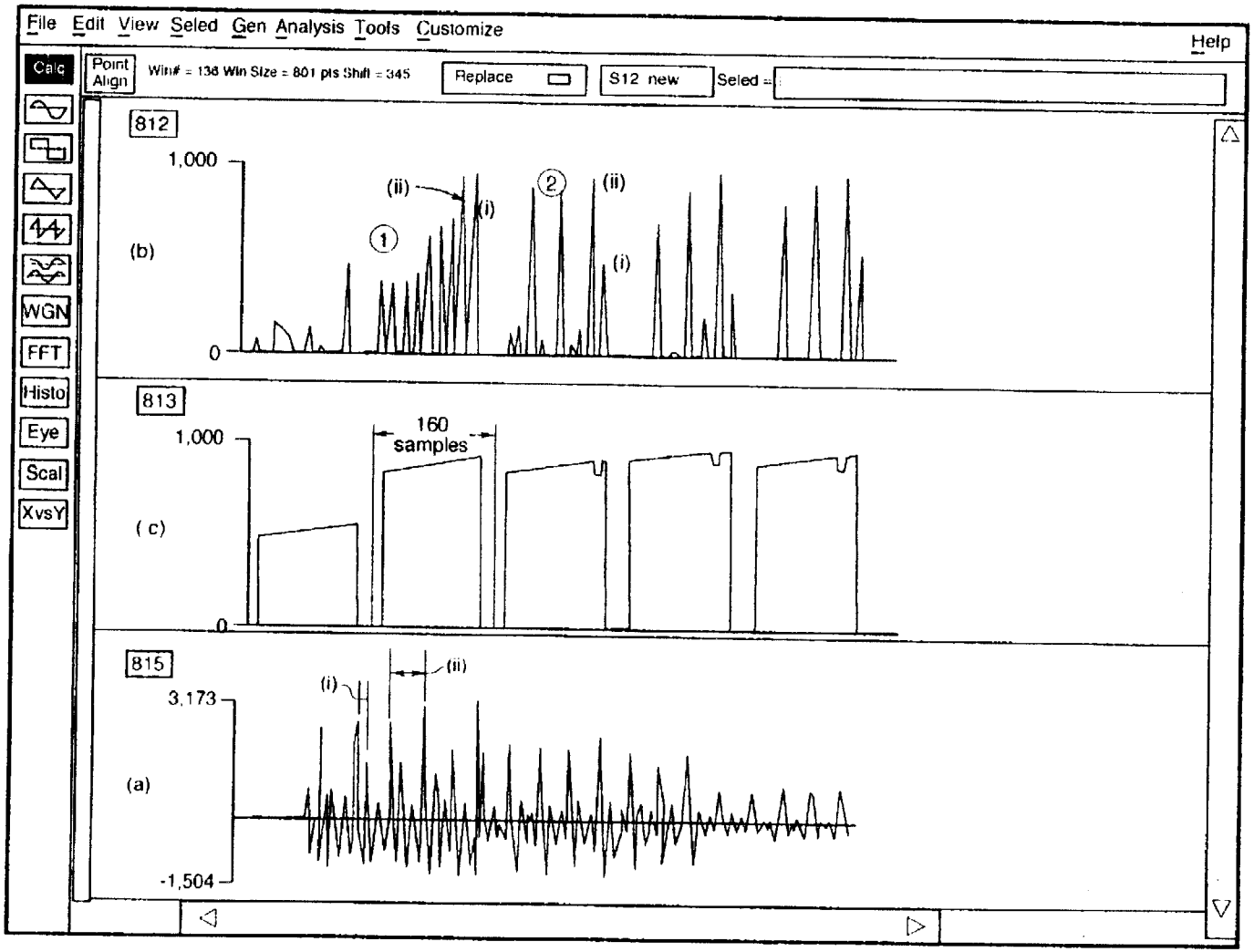
FIG. 10 illustrates a prior art method using a fixed window method, whereby
Figure 10A:
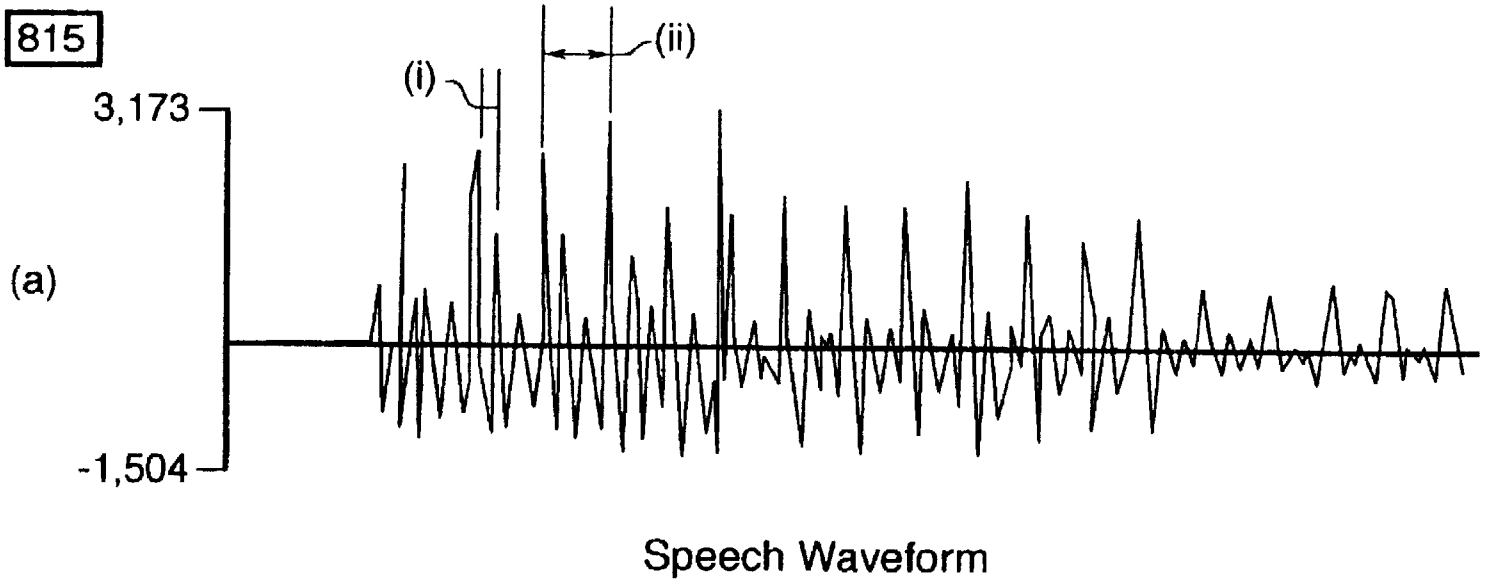
FIG. 10*a* illustrates a sample speech waveform.

FIG. 10 illustrates a correlation-based pitch estimation method using a fixed window method according to the prior art. FIG. 10*a* illustrates a sequence of speech samples where a transition from unvoiced to voiced speech is occurring. The waveform is marked <—> at two positions. The reference (ii) indicates the distance between two main peaks of the true pitch period of this speech, which is 42 samples. The reference (i) indicates the distance between two peaks of the First Formant in this speech segment, which is 14 samples.

Figure 10B:
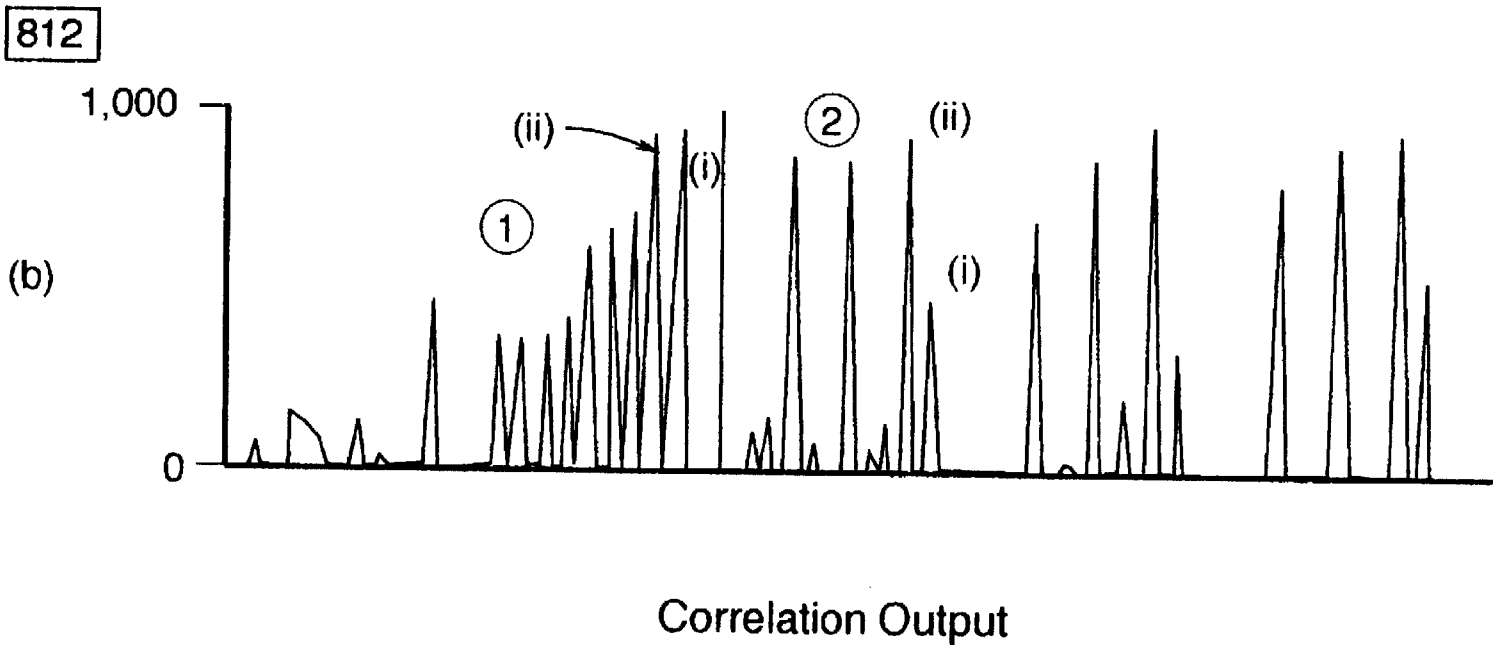
FIG. 10*b* illustrates a correlation output from the speech waveform of FIG. 10*a* using a frame size of 160 samples.
Figure 10C:
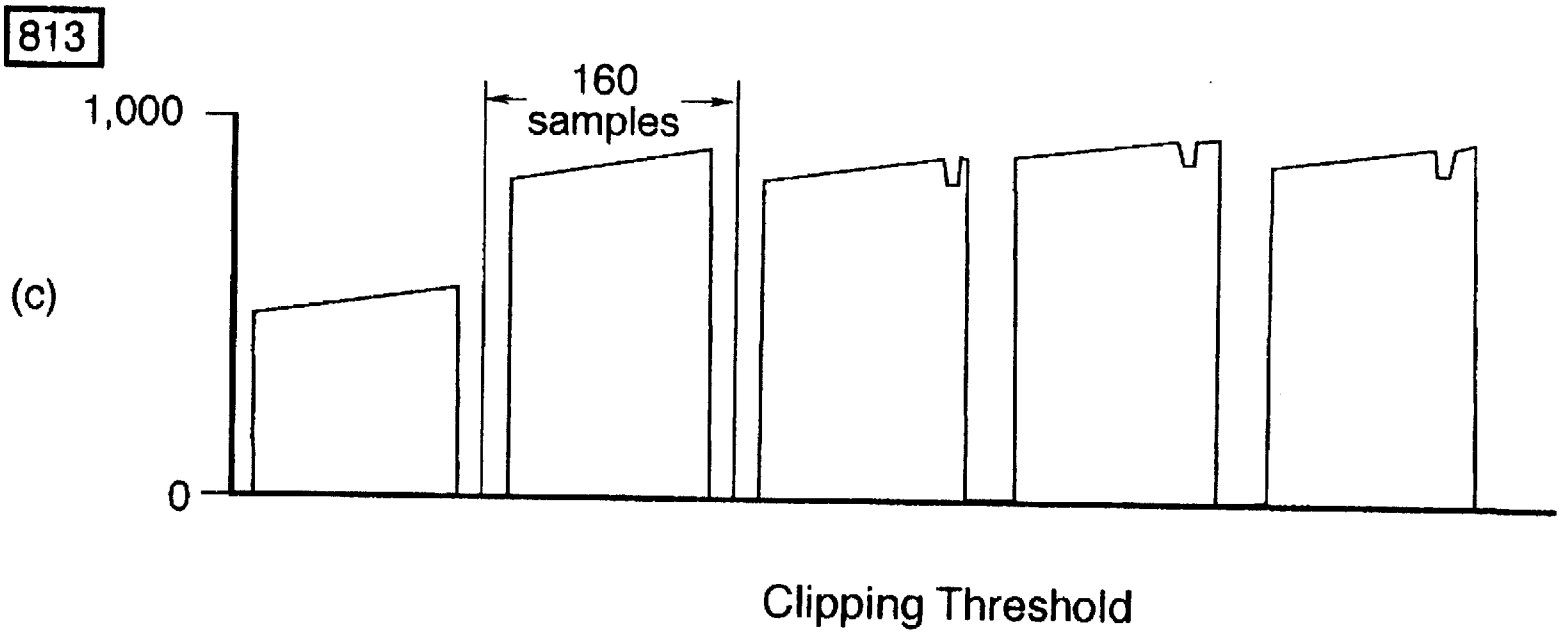
FIG. 10*c* illustrates the clipping threshold used to reduce the number of peaks in the estimation process.

The results of calculating the correlation coefficient for frame (1) are shown in FIG. 10*b* and the dipping threshold is shown in FIG. 10*c*. It is clear from examination of FIG. 10*b* that strong peaks exist above the clipping threshold at d=28 and d=42 samples respectively. The peak at 42 samples delay is the true pitch, and the multiple of this true pitch value can be seen at a delay of 84 samples. However, this multiple is below the clipping threshold. The peak at 28 is the second multiple of the First Formant at 14 samples delay and is strong enough to appear above the clipping threshold. This peak also has several multiples repeating at 14 sample periods.

Prior art pitch estimation methods used for this waveform would determine, incorrectly, that the period of this speech is 28 samples. In this case, the calculation of the correlation coefficient using two sequences of 28 samples has "locked on" to the short term nature of the First Formant information and produced a high value at a delay of 28 samples. As shown in FIGS. 10*b* and 10*a*, this short term effect dies away with the result that in subsequent frames, the 28 sample peak reduces in amplitude and is no longer considered in the pitch estimation process.

Adaptive Window Method of the Present Invention

Figure 11:
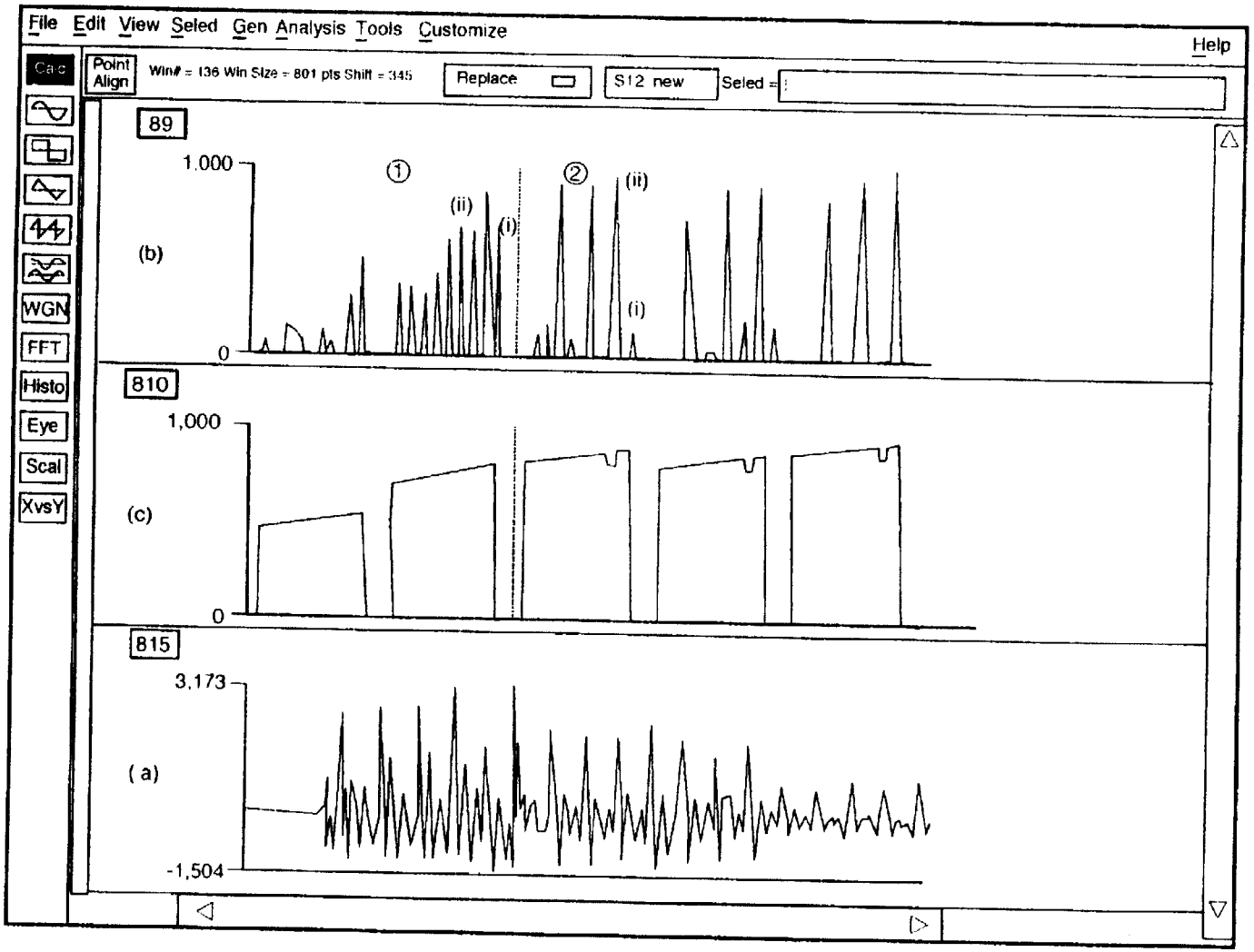
FIG. 11 illustrates the adaptive window method of the present invention, whereby
Figure 11A:
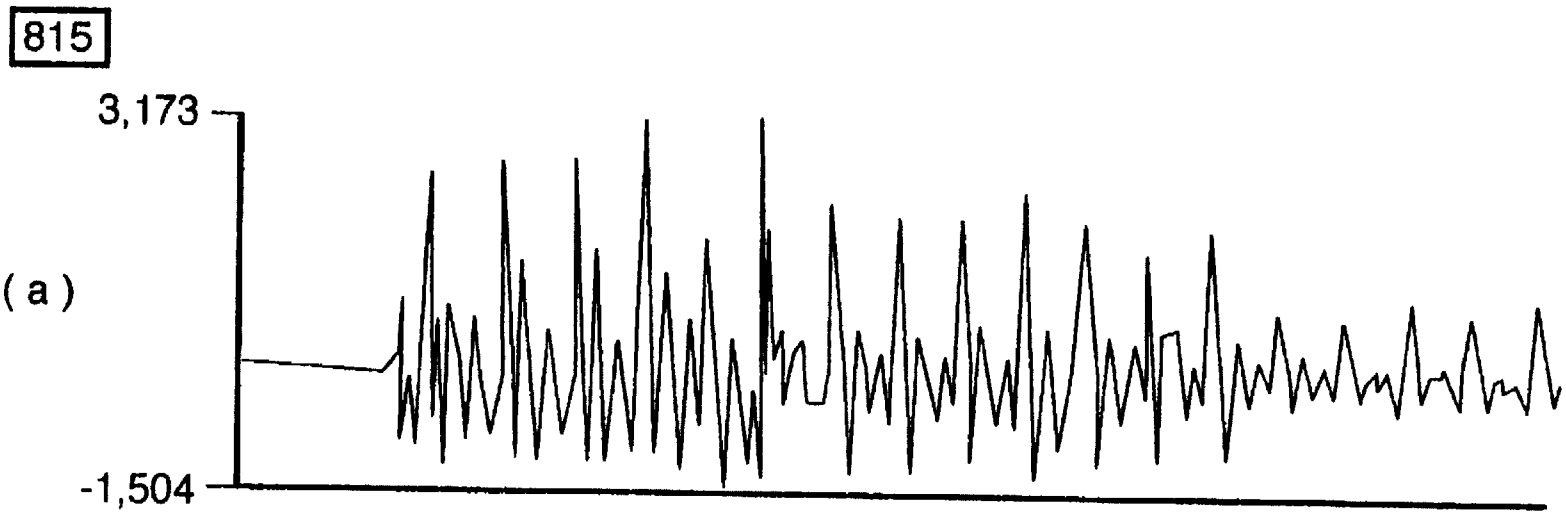
FIG. 11*a* illustrates a sample speech waveform.
Figure 11B:
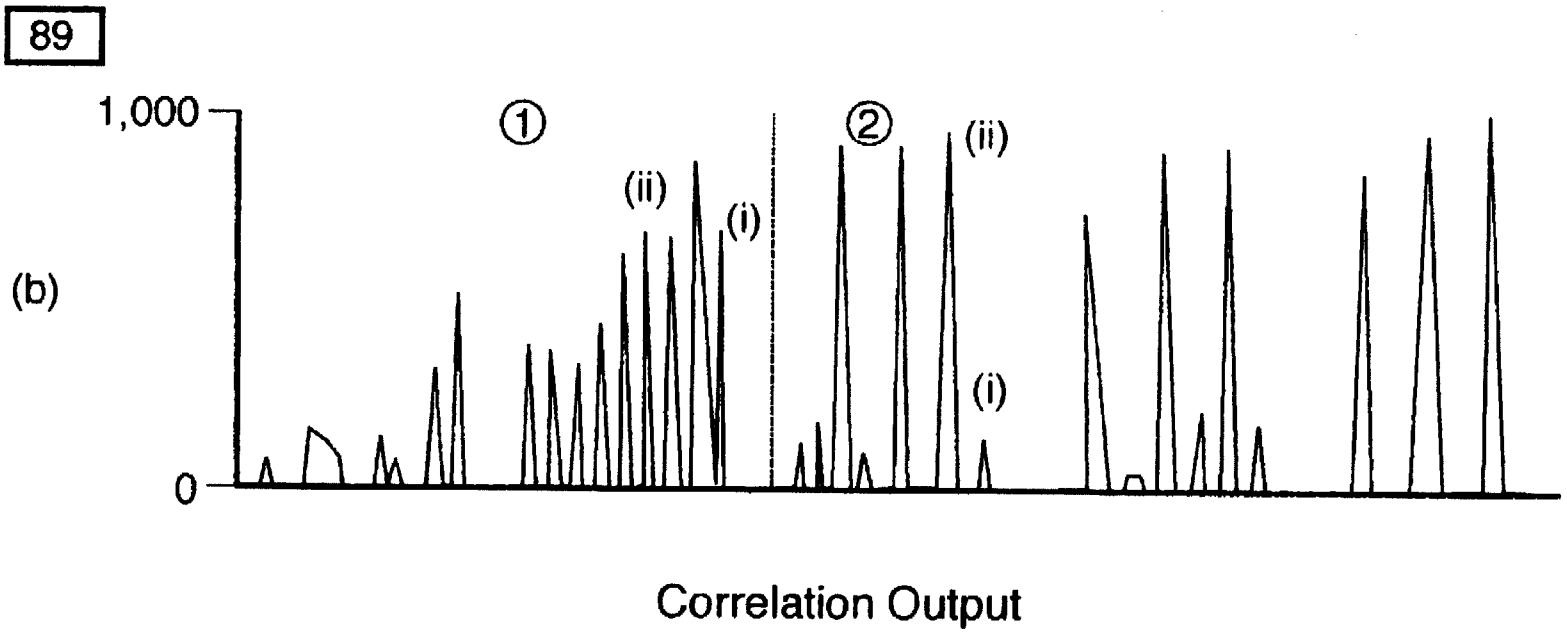
FIG. 11*b* illustrates a correlation output from the speech waveform of FIG. 11*a* using a frame size of 160 samples.
Figure 11C:
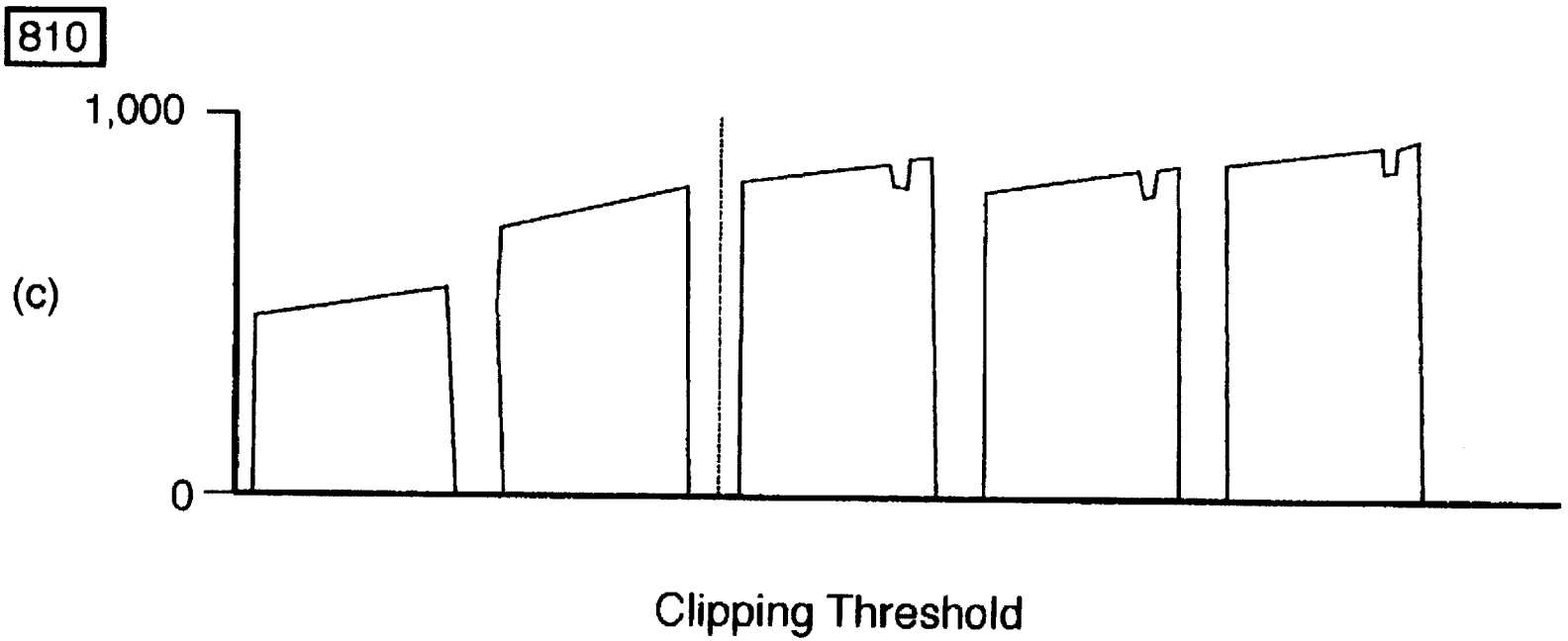
FIG. 11*c* illustrates the clipping threshold used to reduce the number of peaks in the estimation process.

FIG. 11 illustrates a correlation-based pitch estimation method using an adaptive or dynamically adjustable window method according to the present invention. FIG. 11*a* illustrates the speech waveform of FIG. 10*a*, FIG. 11*b* illustrates the results of calculating the correlation coefficient for the waveform using the adaptive window method of the present invention, and FIG. 11*c* illustrates the clipping threshold. Closer examination of the waveform shown in FIGS. 10*a* and 11*a* illustrates that the First Formant effect dies away as the speech sequence progresses. Thus, if the number of samples used to calculate the correlation for delay 28 was increased, the short term effect would not contribute as much to the overall correlation calculation, since this effect reduces as the waveform progresses.

The present invention dynamically adjusts the correlation sample window when a transition from unvoiced to voiced speech is entered to more accurately disregard these false peaks. Therefore, the present invention comprises an improved vocoder system and method for more accurately estimating the pitch parameter. The present invention comprises an improved correlation system and method for estimating the pitch parameter which more accurately disregards false correlation peaks resulting from the contribution of the First Formant to the pitch estimation method.

FIG. 12—Flowchart Diagram

Figure 12A:
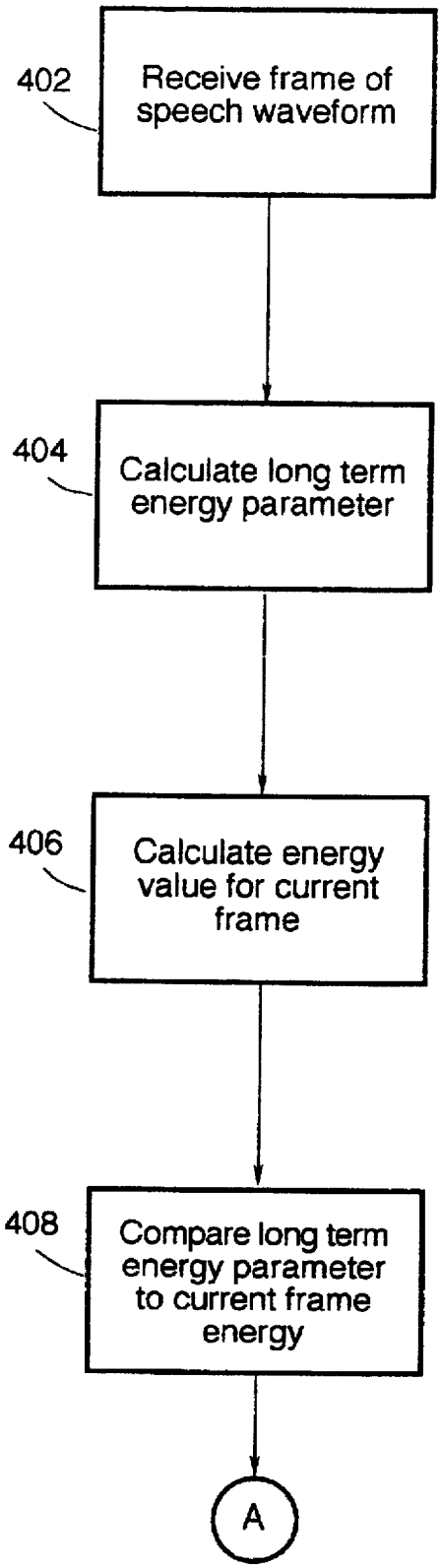
FIG. 12*a* and 12*b* are flowchart diagrams illustrating operation of the pitch estimation method of the present invention.
Figure 12B:
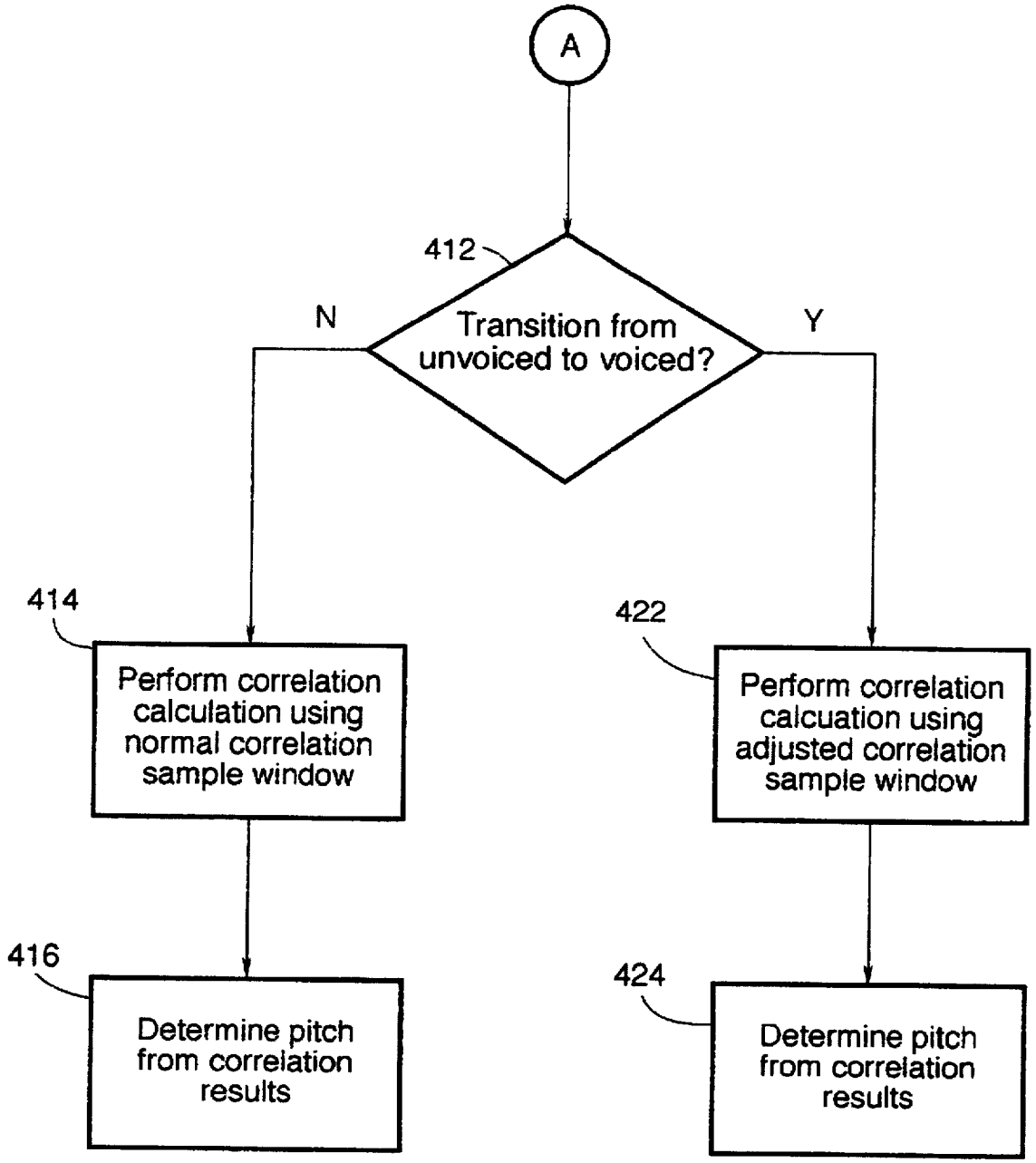

Referring now to FIG. 12, a flowchart diagram illustrating operation of the present invention is shown. The flowchart of FIG. 12 is shown in two portions referred to as FIG. 12*a* and FIG. 12*b*. In step 402 the vocoder receives a frame of the speech waveform to generate a parametric representation of the received waveform. More particularly, the vocoder receives a current frame to estimate the pitch of the frame.

In steps 404–412 the vocoder determines if a transition from unvoiced to voiced speech is occurring. As shown, in step 404 the vocoder computes a long term frame energy parameter. The vocoder of the present invention preferably computes a long term frame energy calculation of the form:

$$\text{Long Term Average Energy } (LTAE) = \frac{1}{M} \sum_{p=1}^{M} [E(p)]$$

where E(p) for p=1 to M are the frame energies for the previous M frames.

The energy value for a current frame referred to as 0 is computed as:

$$E(0) = a * \sum_{n=0}^{N-1} x(n)^2$$

where x(n) are frame samples for the current frame and a is a scaling factor.

In step 406 the vocoder calculates an energy value for the current frame, preferably using the above energy calculation for E(0).

In step 408 the vocoder compares the long term average energy parameter to the current frame energy and in step 412 (FIG. 12*b*) determines if a transition from unvoiced to voiced speech is occurring. When a voiced segment of speech is entered, the current energy E(n) increases by an amount which makes the current energy much larger than the Long Term Energy Average by a fixed threshold. In the preferred embodiment, the vocoder in steps 408 and 412 determines if:

$$E(0)/LTAE > b$$

where b is the threshold. In the preferred embodiment, b is dependent on the scaling factor a and the number of previous unvoiced frames. If the ratio of the current energy to the long term energy is greater than the threshold, then the current frame is presumed to be a transition frame from unvoiced to voiced speech.

If the current frame is determine to not be a transition frame from unvoiced to voiced, then in step 414 the vocoder uses the normal correlation sample window. After performing the correlation calculation in step 414, in step 416 the vocoder determines the pitch from the correlation results.

If the current frame is determined to be a transition frame from unvoiced to voiced speech in step 412, then in step 422 the vocoder widens the correlation sample window. In other words, if the current frame is determined to be a transition frame from unvoiced to voiced speech, the vocoder performs a correlation calculation using an adjusted or widened correlation sample window. The vocoder adjusts the correlation sample window to a larger value to reduce the effects of the first Formant in the correlation peak analysis. In the preferred embodiment, the vocoder widens the correlation sample window to 50 samples. Thus, in computing correlation coefficients for delay samples 21–50, a correlation sample window of 50 is used.

FIG. 11*b* illustrates the results for calculating the correlation coefficient where, just prior to the waveform's transition from unvoiced to voiced speech, the number of samples used to calculate the correlation coefficient is increased to 50 for all possible pitch periods below 50 samples. In other words, FIG. 11*b* illustrates the correlation calculation results where, for all pitch calculations for periods less than 50 samples, the correlation calculation uses two sequences of 50 samples in the correlation calculation. As shown, this increased or widened correlation sample window during this transition period more accurately reduces the effect of the first Formant in the speech analysis.

Thus, the present invention compares the long term frame energy parameter to the current frame energy to determine when such a transition occurs and dynamically adjusts the correlation sample window accordingly. Once this frame and one or more subsequent frames have been classified as voiced, the correlation sample window can be reduced to its original value. In the preferred embodiment, when the current frame and the next have been classified as voiced, the correlation sample window is reduced to its original value.

FIG. 13—Flowchart Diagram

Figure 13A:
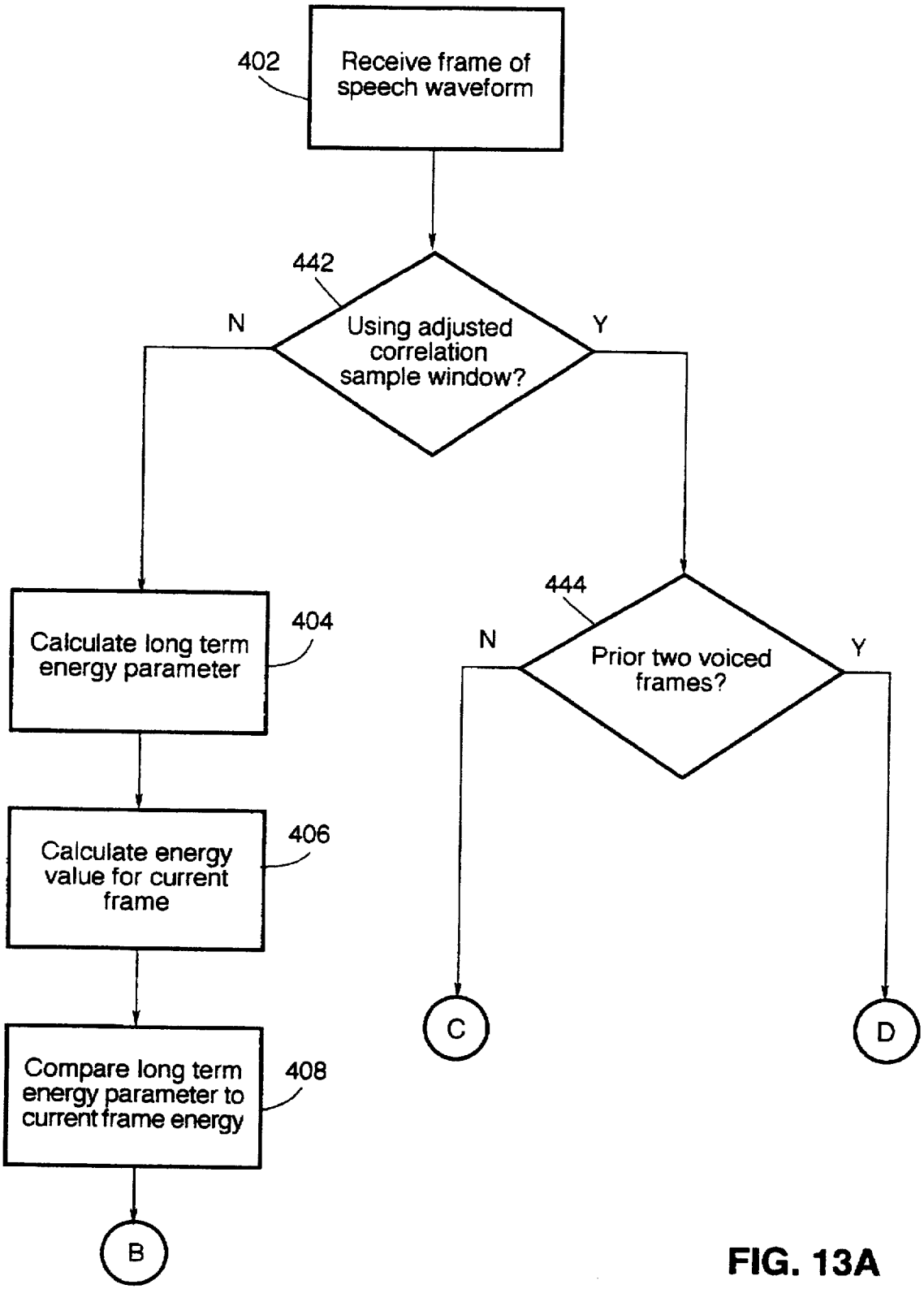
FIG. 13*a* and 13*b* are more detailed flowchart diagrams illustrating operation of the pitch estimation method of the present invention.
Figure 13B:
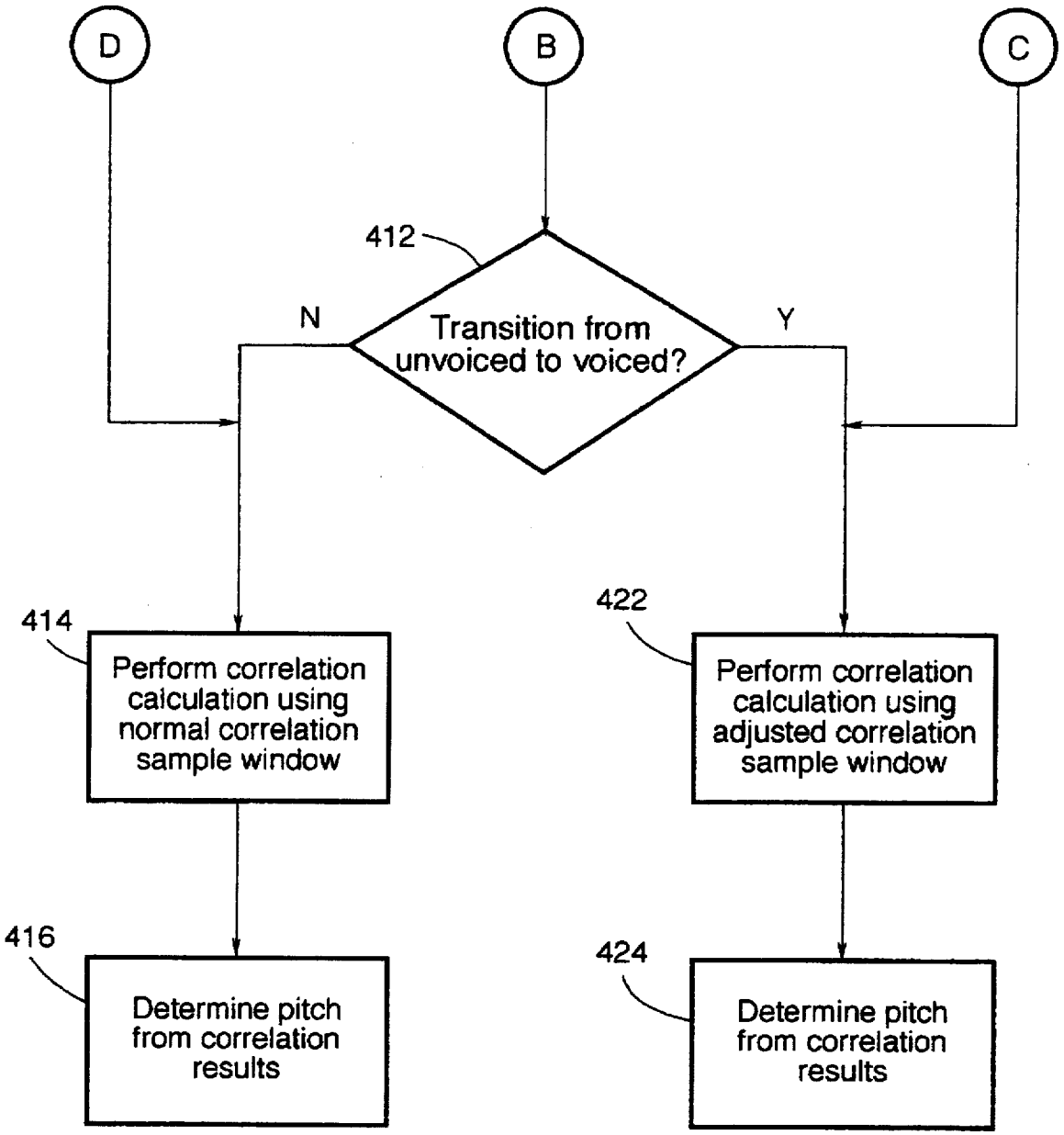

Referring now to FIG. 13, a more detailed flowchart diagram illustrating operation of the present invention is shown. The flowchart of FIG. 13 is similar to the flowchart of FIG. 12, but includes additional steps which control use of the widened correlation sample window for 2 voiced frames prior to returning to the normal correlation sample window. The flowchart of FIG. 13 is shown in two portions referred to as FIG. 13*a* and FIG. 13*b*. Steps in FIG. 13 which are similar or identical to steps in FIG. 12 have the same reference numerals for convenience.

In step 402 the vocoder receives a frame of the speech waveform to generate a parametric representation of the received waveform. More particularly, the vocoder receives the frame to estimate the pitch of the frame. In step 442 the vocoder determines if the adjusted or widened correlation sample window is currently being used. If not, then operation proceeds to step 404, and operation proceeds as described above. As described above, in step 404 the vocoder computes a long term frame energy parameter, in step 406 the vocoder calculates an energy value for the current frame, in step 408 the vocoder compares the long term average energy parameter to the current frame energy, and in step 412 (FIG. 13*b*) the vocoder determines if a transition from unvoiced to voiced speech is occurring. The vocoder then performs the correlation calculation using either the normal or adjusted sample window depending on whether a transition from unvoiced to voiced speech is determined to be occurring in step 412.

Thus if the vocoder is not currently using the adjusted or widened correlation sample window as determined in step 442, then steps 404–412 are performed as described above, and either the normal or adjusted correlation sample window is used dependent on whether the vocoder detects a transition from unvoiced to voiced speech. In other words, if the decision in step 442 is negative, then steps 404–412 are performed as described above, and either steps 414 and 416, or steps 422 and 424, are performed based on the determination in step 412.

If the vocoder is currently using the adjusted sample window in step 442, then operation proceeds to step 444. If the vocoder is currently using the adjusted correlation sample window in step 442, then this indicates that a transition from unvoiced to voiced speech occurred in a relatively prior frame. In the preferred embodiment where the adjusted sample window is only used for two consecutive voiced frames, this means that the transition occurred in either the preceding frame or two frames ago.

In step 444 the vocoder determines if the prior two frames have been classified as voiced frames. In the preferred embodiment, the vocoder uses the widened correlation sample window during one or more transition frames from unvoiced to voiced speech, and the widened sample window is only used until the two consecutive frames have been classified as voiced. It is noted that other criteria may be used to determine how long the widened correlation sample window should be used, as desired.

If the prior two frames have been classified as voiced frames in step 444, then operation advances to step 414 (FIG. 13*b*), where the correlation calculation is performed using the normal correlation sample window. If the two prior frames have not been classified as voiced frames, then it is assumed that a transition from unvoiced to voiced speech is still occurring and/or the widened sample window is still desired, and operation proceeds to step 422 (FIG. 13*b*). In step 422 the vocoder performs the correlation calculation using the adjusted or widened correlation sample window.

Performance

The immediate effect of the widened correlation sample window is clearly seen in a comparison of FIGS. 10*b* and 11*b*. As shown in FIG. 10*b*, the "rogue" or false First Formant peak at a delay of 28 samples, designated as (i), is sufficiently high to be falsely detected as the pitch. As shown in the comparison of FIGS. 10*b* and 11*b*, this "rogue" or false First Formant peak, designated as (i), is reduced in FIG. 11*b* and is below the clipping threshold. This is due to the widened correlation sample window of the present invention.

Examination of subsequent frames in FIG. 10*b* shows that once the waveform has transitioned to voiced, it is not necessary to retain the wider sample window for the correlation calculations. The wider sample window is not necessary because, once the waveform has transitioned to voiced speech, the Formant peak does not rise above the clipping threshold. However, as shown from FIGS. 10*b* and 11*b*, the First Formant peak is considerably reduced by retaining the larger sample window. Since the wider correlation sample window requires increased computation, the widened correlation sample window is preferably only used in frames where false pitch estimates would otherwise occur.

Therefore, the present invention more accurately provides the correct pitch parameter in response to a sampled speech waveform. More specifically, the present invention dynamically adjusts the pitch estimation window during unvoiced to voiced speech transitions. This improves the pitch estimation process and more accurately mitigates the effects of the First Formant. The present invention enhances the performance of the correlation calculation by widening the calculation window at one or more transition frames, and then returning the calculation window to its normal value for subsequent voiced frames. Thus, for a small increase in computation during the transition frame, the pitch estimation process has been improved and the effects of the First Formant in voiced speech has been mitigated.

Conclusion

Therefore, the present invention comprises an improved vocoder system and method for more accurately detecting the pitch of a sampled speech waveform. The present invention reduces the effects of the First Formant in the pitch estimation and thus provides improved results.

Although the system and method of the present invention has been described in connection with the preferred embodiment, it is not intended to be limited to the specific form set forth herein, but on the contrary, it is intended to cover such alternatives, modifications, and equivalents, as can be reasonably included within the spirit and scope of the invention as defined by the appended claims.

I claim:

1. A method for estimating pitch in a speech waveform, wherein the speech waveform includes a plurality of frames each comprising a plurality of samples, the method comprising:

calculating a long term energy parameter for a plurality of said frames of said speech waveform;

calculating an energy value for a current frame;

comparing said long term energy parameter to the current frame energy value to determine if a transition from unvoiced to voiced speech is occurring;

adjusting a correlation sample window for said current frame if said comparing determines that a transition from unvoiced to voiced speech is occurring; and performing a correlation calculation on said current frame of the speech waveform using said adjusted correlation sample window if said comparing determines that a transition from unvoiced to voiced speech is occurring, wherein the correlation calculation for said current frame produces one or more correlation peaks at respective numbers of delay samples, wherein said adjusted correlation sample window reduces the effect of the first Formant in the pitch estimation; and determining a single correlation peak from said one or more correlation peaks, wherein said single correlation peak indicates a pitch of the speech waveform.

2. The method of claim 1, wherein said adjusting the correlation sample window comprises widening the correlation sample window.

3. The method of claim 2, wherein said widening the correlation sample window comprises widening the correlation sample window to approximately 50 samples.

4. The method of claim 1, wherein said comparing said long term frame energy parameter to the current frame energy to determine if a transition from unvoiced to voiced speech is occurring comprises:

calculating a ratio of said long term frame energy parameter to the current frame energy; and comparing said ratio with a threshold value to determine if said ratio is greater than said threshold value.

5. The method of claim 1, wherein said calculating said long term energy parameter for a plurality of said frames comprises computing:

$$\text{Long Term Average Energy } (LTAE) = \frac{1}{M} \sum_{p=1}^{M} [E(p)]$$

where E(p) for p=1 to M are the frame energies for the previous M frames.

6. The method of claim 1, wherein said comparing said long term energy parameter to the current frame energy value comprises determining if:

$$E(0) = a * \sum_{n=0}^{N-1} x(n)^2$$

where x(n) are frame samples for the current frame and a is a scaling factor.

7. The method of claim 1, wherein the correlation sample window has an original value prior to said adjusting, the method further comprising:

setting the correlation sample window to its original value after said performing said correlation calculation on the current frame of the speech waveform using said adjusted correlation sample window.

8. The method of claim 1, further comprising:

performing a correlation calculation on one or more subsequent frames to said current frame using said adjusted correlation sample window if said comparing determines that a transition from unvoiced to voiced speech is occurring.

9. The method of claim 8, wherein the correlation sample window has an original value prior to said adjusting, the method further comprising:

setting the correlation sample window to its original value after said performing said correlation calculation on said one or more subsequent frames to said current frame using said adjusted correlation sample window.

10. The method of claim 1, wherein the correlation sample window has an original value prior to said adjusting, the method further comprising:

designating one or more subsequent frames to said current frame as voiced frames;

setting the correlation sample window to its original value after said one or more subsequent frames to said current frame have been designated as voiced frames if said comparing determines that a transition from unvoiced to voiced speech is occurring.

11. A method for estimating pitch in a speech waveform, wherein the speech waveform includes a plurality of frames each comprising a plurality of samples, the method comprising:

determining if a transition from unvoiced to voiced speech is occurring in a current frame;

adjusting a correlation sample window for said current frame if said comparing determines that a transition from unvoiced to voiced speech is occurring; and performing a correlation calculation on said current frame of the speech waveform using said adjusted correlation sample window if said determining determines that a transition from unvoiced to voiced speech is occurring in said current frame, wherein the correlation calculation for said current frame produces one or more correlation peaks at respective numbers of delay samples, wherein said adjusted correlation sample window reduces the effect of the first Formant in the pitch estimation; and determining a single correlation peak from said one or more correlation peaks, wherein said single correlation peak indicates a pitch of the speech waveform.

12. The method of claim 11, wherein said determining comprises:

calculating a long term energy parameter for a plurality of said frames of said speech waveform;

calculating an energy value for the current frame; and comparing said long term energy parameter to the current frame energy value to determine if a transition from unvoiced to voiced speech is occurring.

13. The method of claim 12, wherein said comparing said long term frame energy parameter to the current frame energy to determine if a transition from unvoiced to voiced speech is occurring comprises:

calculating a ratio of said long term frame energy parameter to the current frame energy; and comparing said ratio with a threshold value to determine if said ratio is greater than said threshold value.

14. The method of claim 12, wherein said calculating said long term energy parameter for a plurality of said frames comprises computing:

$$\text{Long Term Average Energy } (LTAE) = \frac{1}{M} \sum_{p=1}^{M} [E(p)]$$

where E(p) for p=1 M are the frame energies for the previous M frames.

15. The method of claim 12, wherein said comparing said long term energy parameter to the current frame energy value comprises determining if:

$$E(0) = a * \sum_{n=0}^{N-1} x(n)^2$$

where x(n) are frame samples for the current frame and a is a scaling factor.

16. The method of claim 11, wherein said adjusting the correlation sample window comprises widening the correlation sample window.

17. The method of claim 16, wherein said widening the correlation sample window comprises widening the correlation sample window to approximately 50 samples.

18. The method of claim 11, wherein the correlation sample window has an original value prior to said adjusting, the method further comprising:

setting the correlation sample window to its original value after said performing said correlation calculation on the current frame of the speech waveform using said adjusted correlation sample window.

19. The method of claim 11, further comprising:

performing a correlation calculation on one or more subsequent frames to said current frame using said adjusted correlation sample window if said comparing determines that a transition from unvoiced to voiced speech is occurring.

20. The method of claim 19, wherein the correlation sample window has an original value prior to said adjusting, the method further comprising:

setting the correlation sample window to its original value after said performing said correlation calculation on said one or more subsequent frames to said current frame using said adjusted correlation sample window.

21. The method of claim 11, wherein the correlation sample window has an original value prior to said adjusting, the method further comprising:

designating one or more subsequent frames to said current frame as voiced frames;

setting the correlation sample window to its original value after said one or more subsequent frames to said current frame have been designated as voiced frames if said comparing determines that a transition from unvoiced to voiced speech is occurring.

22. The method of claim 11, wherein the correlation sample window has an original value prior to said adjusting, the method further comprising:

designating the current frame as a voiced frame after said comparing if said comparing determines that a transition from unvoiced to voiced speech is occurring;

setting the correlation sample window to its original value after said designating and after one or more subsequent frames have been designated as voiced frames.

23. A vocoder for generating a parametric representation of speech signals, wherein the vocoder more accurately estimates pitch in a speech waveform, the vocoder comprising:

means for receiving a plurality of digital samples of a speech waveform, wherein the speech waveform includes a plurality of frames each comprising a plurality of samples;

a processor for calculating a plurality of parameters for each of said frames, wherein said processor determines a pitch value for each of said frames;

wherein said processor performs a correlation calculation on each frame of the speech waveform which produces one or more correlation peaks at respective numbers of delay samples, wherein said processor determines a single correlation peak from said one or more correlation peaks to estimate the pitch of the received waveform;

wherein said processor determines if a transition from unvoiced to voiced speech is occurring in a current frame and adjusts a correlation sample window for the current frame if a transition from unvoiced to voiced speech is occurring; and wherein said processor performs a correlation calculation on the current frame of the speech waveform using the adjusted correlation sample window if a transition from unvoiced to voiced speech is occurring in the current frame, wherein the adjusted correlation sample window reduces the effect of the first Formant in the pitch estimation.

24. The vocoder of claim 23, wherein said processor comprises:

means for calculating a long term energy parameter for a plurality of said frames of said speech waveform;

means for calculating an energy value for the current frame; and means for comparing said long term energy parameter to the current frame energy value to determine if a transition from unvoiced to voiced speech is occurring.

25. The vocoder of claim 24, wherein said means for comparing calculates a ratio of said long term frame energy parameter to the current frame energy and compares the ratio with a threshold value to determine if the ratio is greater than said threshold value.

26. The vocoder of claim 24, wherein said means for comparing calculates the long term energy parameter as follows:

$$\text{Long Term Average Energy } (LTAE) = \frac{1}{M} \sum_{p=1}^{M} [E(p)]$$

E(p) for p=1 to M are the frame energies for the previous M frames.

27. The vocoder of claim 24, wherein said means for comparing determines if:

$$E(0) = a * \sum_{n=0}^{N-1} x(n)^2$$

where x(n) are frame samples for the current frame and a is a scaling factor.

28. The vocoder of claim 23, wherein said processor widens the correlation sample window for the current frame if a transition from unvoiced to voiced speech is occurring.

29. The vocoder of claim 23, wherein said processor sets the correlation sample window to an original value after said processor performs said correlation calculation on the current frame of the speech waveform using said adjusted correlation sample window.

* * * * *

UNITED STATES PATENT AND TRADEMARK OFFICE

CERTIFICATE OF CORRECTION

PATENT NO. : 5,696,873
DATED : December 9, 1997
INVENTOR(S) : John G. Bartkowiak It is certified that error appears in the above-identified patent and that said Letters Patent is hereby corrected as shown below:

Claim 14, col. 13, line 64, please add the word "to" after "1" and before "M".

Claim 26, col. 16, line 10, please add the word "where" before "E(p)".

Signed and Sealed this

Tenth Day of March, 1998

Bruce Lehman

*Attest:*

BRUCE LEHMAN

*Attesting Officer*

*Commissioner of Patents and Trademarks*